US007202829B2

(12) United States Patent
Lan

(10) Patent No.: US 7,202,829 B2
(45) Date of Patent: Apr. 10, 2007

(54) BROADBAND MOBILE ANTENNA WITH INTEGRATED MATCHING CIRCUITS

(75) Inventor: Kang Lan, St-Lambert (CA)

(73) Assignee: Comprod Communications Ltd., Boucherville, Québec (CA)

( * ) Notice: Subject to any disclaimer, the term of this patent is extended or adjusted under 35 U.S.C. 154(b) by 31 days.

(21) Appl. No.: 11/218,514

(22) Filed: Sep. 6, 2005

(65) Prior Publication Data

US 2006/0049996 A1 Mar. 9, 2006

(30) Foreign Application Priority Data

Sep. 3, 2004 (CA) ..... 2480581

(51) Int. Cl.
*H01Q 9/00* (2006.01)

(52) U.S. Cl. ..... 343/749; 343/715; 343/860

(58) Field of Classification Search ..... 343/715, 343/722, 749, 850, 860
See application file for complete search history.

(56) References Cited

U.S. PATENT DOCUMENTS

| | | | | |
|---|---|---|---|---|
| 3,100,893 | A * | 8/1963 | Brueckmann | 343/713 |
| 3,725,942 | A * | 4/1973 | Ukmar | 343/715 |
| 3,950,757 | A | 4/1976 | Blass | |
| 4,028,704 | A | 6/1977 | Blass | |
| 4,141,016 | A | 2/1979 | Nelson | |
| 4,443,803 | A | 4/1984 | DeSantis et al. | |
| 4,618,997 | A | 10/1986 | Imazeki et al. | |
| 4,890,116 | A | 12/1989 | Lewis | |
| 4,958,164 | A | 9/1990 | Lewis | |
| 4,965,607 | A | 10/1990 | Wilkins et al. | |
| 5,111,213 | A * | 5/1992 | Jahoda et al. | 343/722 |
| 5,604,507 | A | 2/1997 | Openlander | |
| 5,844,525 | A | 12/1998 | Hayes et al. | |
| 5,898,408 | A | 4/1999 | Du | |
| 5,963,168 | A | 10/1999 | Brennan | |
| 6,229,495 | B1 | 5/2001 | Lopez et al. | |
| 6,429,821 | B1 * | 8/2002 | Lewis, Jr. | 343/749 |
| 6,452,556 | B1 | 9/2002 | Ha et al. | |

FOREIGN PATENT DOCUMENTS

| | | |
|---|---|---|
| JP | 10-098321 | 4/1998 |

* cited by examiner

*Primary Examiner*—Tho Phan
(74) *Attorney, Agent, or Firm*—Robic; Gonzalo Lavin

(57) ABSTRACT

A wide band mobile antenna assembly having a whip, a base defining a housing, an adaptor extending on top of the base above the housing, and a mounting element extending in the housing. The mounting element has two opposite PCB mounting side surfaces and two opposite coil mounting surfaces. A PCB is mounted on each of the corresponding PCB mounting side surfaces. A matching circuitry is integrated on the two PCBs. The matching circuitry has a conductor for connection to the whip when the whip is inserted in the adaptor, and a conductor for external cable connection. The matching circuitry has a series resonant network operatively connected to a parallel resonant network for increasing a bandwidth of the antenna assembly. The series and resonant networks each have a coil mounted to the corresponding coil mounting surface.

7 Claims, 7 Drawing Sheets

| Marker | Freq (MHz) | Ch 1 (dB) | Ch 2 (swr) |
|---|---|---|---|
| 1 | 138.000000 | | 1.34 |
| 2 | 144.000000 | | 1.22 |
| 3 | 148.000000 | | 1.28 |
| 4 | 155.000000 | | 1.27 |
| 5 | 160.000000 | | 1.29 |
| 6 | 165.000000 | | 1.39 |
| 7 | 170.000000 | | 1.42 |
| 8 | 174.000000 | | 1.19 |

Front

Left

Back

Right

| Marker | Freq (MHz) | Ch 1 (dB) | Ch 2 (swr) |
|---|---|---|---|
| 1 | 138.000000 | | 1.50 |
| 2 | 144.000000 | | 1.37 |
| 3 | 148.000000 | | 1.31 |
| 4 | 155.000000 | | 1.23 |
| 5 | 160.000000 | | 1.29 |
| 6 | 165.000000 | | 1.33 |
| 7 | 170.000000 | | 1.19 |
| 8 | 174.000000 | | 1.39 |

BROADBAND MOBILE ANTENNA WITH INTEGRATED MATCHING CIRCUITS

FIELD OF THE INVENTION

The present invention relates to a broadband whip antenna with matching circuits integrated inside a small housing.

BACKGROUND OF THE INVENTION

It is difficult to make a whip antenna working in a wide frequency range, for example from 138 MHz to 174 MHz. Although it is highly desired by standard mobile communication and public safety systems, seldom manufacturers around the world can supply such kind of antennas. Furthermore, if good matching is required, for example, VSWR=1.5:1 rather than 2:1, it becomes more difficult for the design and the fabrication.

Normally matching circuits as shown in FIGS. 1A and 1B are used to extend the bandwidth of a whip antenna. However, only 10 to 15 MHz bandwidth in VHF band can be obtained in many half wavelength antennas available in the market.

As summarized in U.S. Pat. No. 5,604,507 (OPENLANDER), many techniques have been developed to broaden the bandwidth of mobile antennas. However, these methods cannot obtain wide enough bandwidth and good enough impedance matching. For comparison, two methods are mentioned here.

The fist one is loading resistors and inductors to the whip. A good example is given in the published paper (IEEE Trans. Antennas and Propagations, Vol. 51, No.3, 2003, pp. 493–502). However, this method needs to cut the whip into two or more than two sections, and a matching circuit is still required, which complicates the fabrication. It has been shown that this kind of method can obtain very wide bandwidth, however, it is difficult to obtain good impedance matching.

The second one is to use coaxial cables with different impedances to widen the bandwidth. An example is Comprod Communications LTD's (Boucherville, Quebec) 148–174 MHz quarter wavelength whip antennas (Part number 572–75). In this design, coaxial cables with different impedances are used to transform the impedance of the whip to around 50 Ω. A tuning box is used to further improve the impedance matching. As VSWR=1.5:1 for the full coverage, this is the best commercial available product for this band. After carefully optimizing the cable lengths and junction capacitances, and tuning the matching boxes, VSWR=1.5:1 may possibly be obtained. However, in the production, it is found that the antenna performance is very sensitive to the cable lengths and junction capacitors. Furthermore, the individual tuning work is necessary and time-consuming. Hence it is very difficult to fabricate.

U.S. Pat. No. 5,604,507 (OPENLANDER) uses inductors and capacitors assembled inside a housing to extend the bandwidth. A toroidal inductor and a parallel resonant network are composed of one inductor and one capacitor. A metal shield is used to provide parasitic capacitors to the matching circuit. The circuit elements are directly soldered together and contained inside the cavity of the housing. Since the two inductors are close to each other, they are positioned carefully to avoid interference between each other and obtain consistent parasitic capacitor from the shield so that the antenna performance can be consistent.

SUMMARY OF THE INVENTION

According to the present invention, there is provided a wide band mobile antenna assembly comprising:

a whip;

a base defining a housing;

an adaptor extending on top of the base above the housing, for receiving a lower end of the whip;

a mounting element extending in the housing, the mounting element having two opposite PCB mounting side surfaces and two opposite coil mounting surfaces;

two PCBs, each PCB being mountable on the corresponding PCB mounting side surface and fitting in the housing; and matching circuitry integrated on the two PCBs, the matching circuitry having a conductor for connection to the whip when the whip is inserted in the adaptor, and a conductor for external cable connection, the matching circuitry having a series resonant network operatively connected to a parallel resonant network for increasing a bandwidth of the antenna assembly, the series and resonant networks each having a coil mountable to the corresponding coil mounting surface.

The invention, its use and its advantages will be better understood upon reading of the following non-restrictive description of preferred embodiments thereof, made with reference to the accompanying drawings, in which like numbers refer to like elements.

DETAILED DESCRIPTION OF THE INVENTION

Figure 1A:
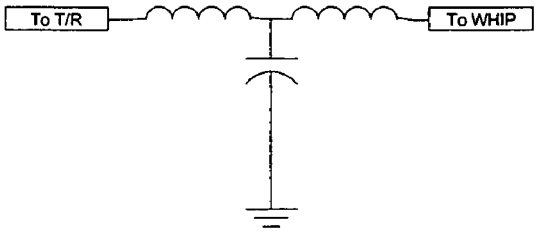
FIG. 1A(PRIOR ART)
FIGS. 1A and 1B are typical matching circuits used for which antennas known in the prior art.
Figure 1B:
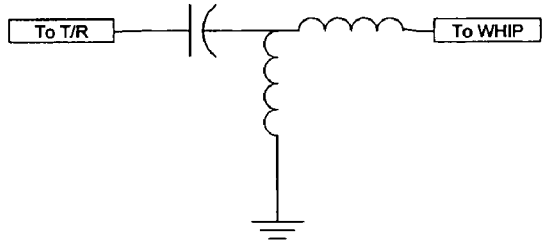
FIG. 1B (PRIOR ART)
Figure 2:
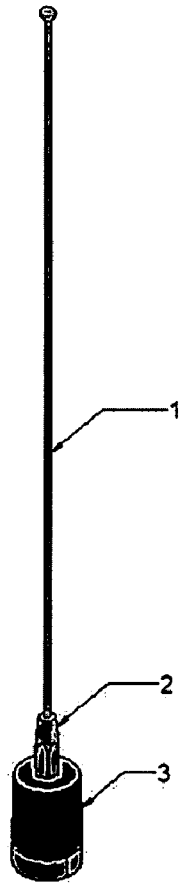
FIG. 2 is a perspective view of a broadband whip antenna assembly, according to a preferred embodiment of the present invention.

Referring to FIG. 2, the outline of the whip antenna according to a preferred embodiment of the present invention is the same as a standard whip antenna. The whip 1 is connected to the housing 3 by means of an adaptor 2. The housing 3 preferably has a plastic envelop and a metal top. The connection between the antenna and the transceiver may follow the standard method. For example, the housing is fixed to the vehicle body by a mounting nut, and wired to the transceiver by a RG58 c/u coaxial cable. Standard contact pins are used to connect the PCBs to the whip and coaxial cable.

Figure 3:
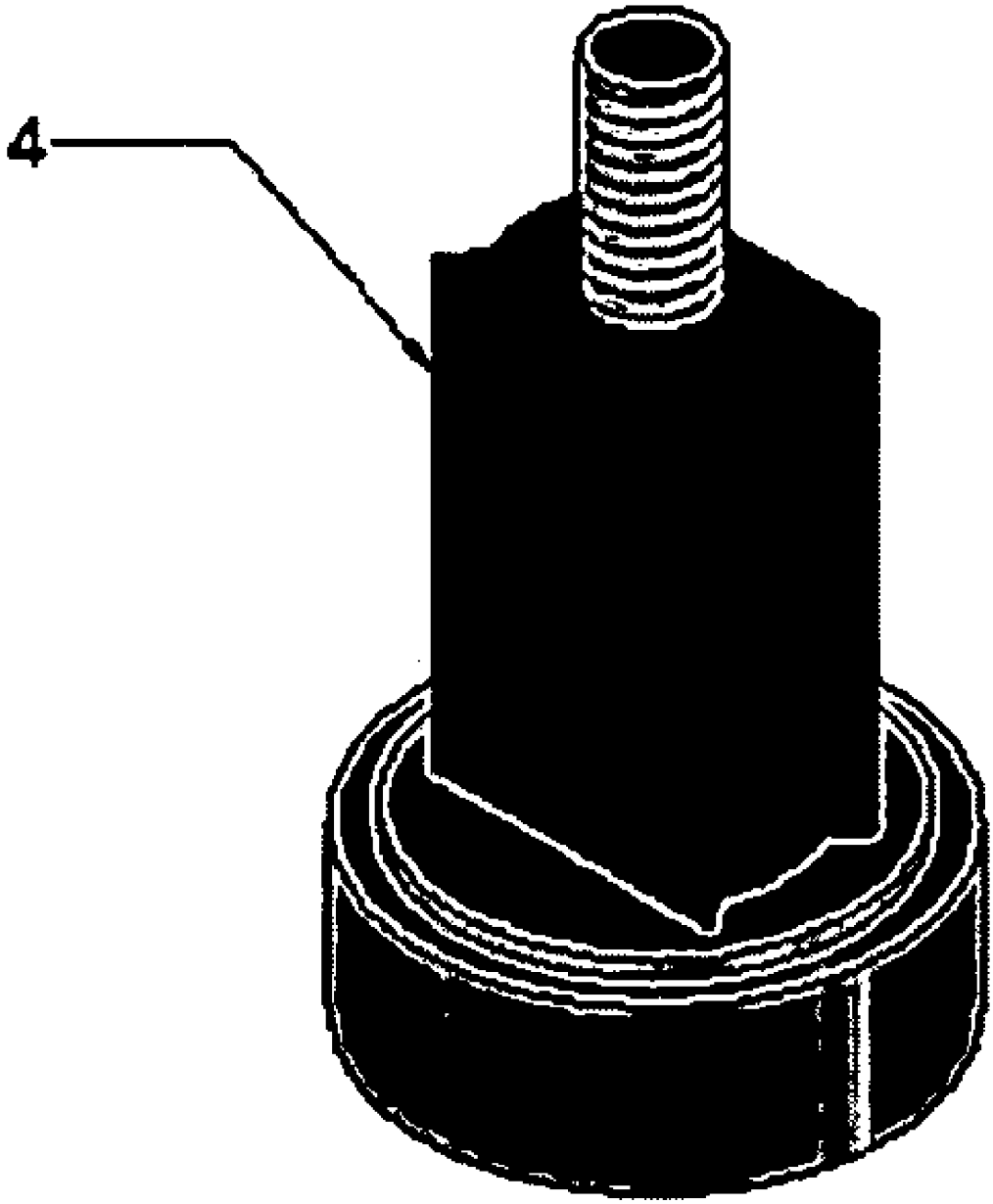
FIG. 3 is a perspective view of the inside structure of a housing of a broadband whip antenna assembly showing only a plastic core, according to a preferred embodiment of the present invention.

Referring to FIG. 3, there is shown the inside structure of the housing before PCBs are loaded. A plastic core or mounting element 4 is used to support the whip. The plastic core 4 has two flat sides where the two PCBs will be attached.

Figure 4:
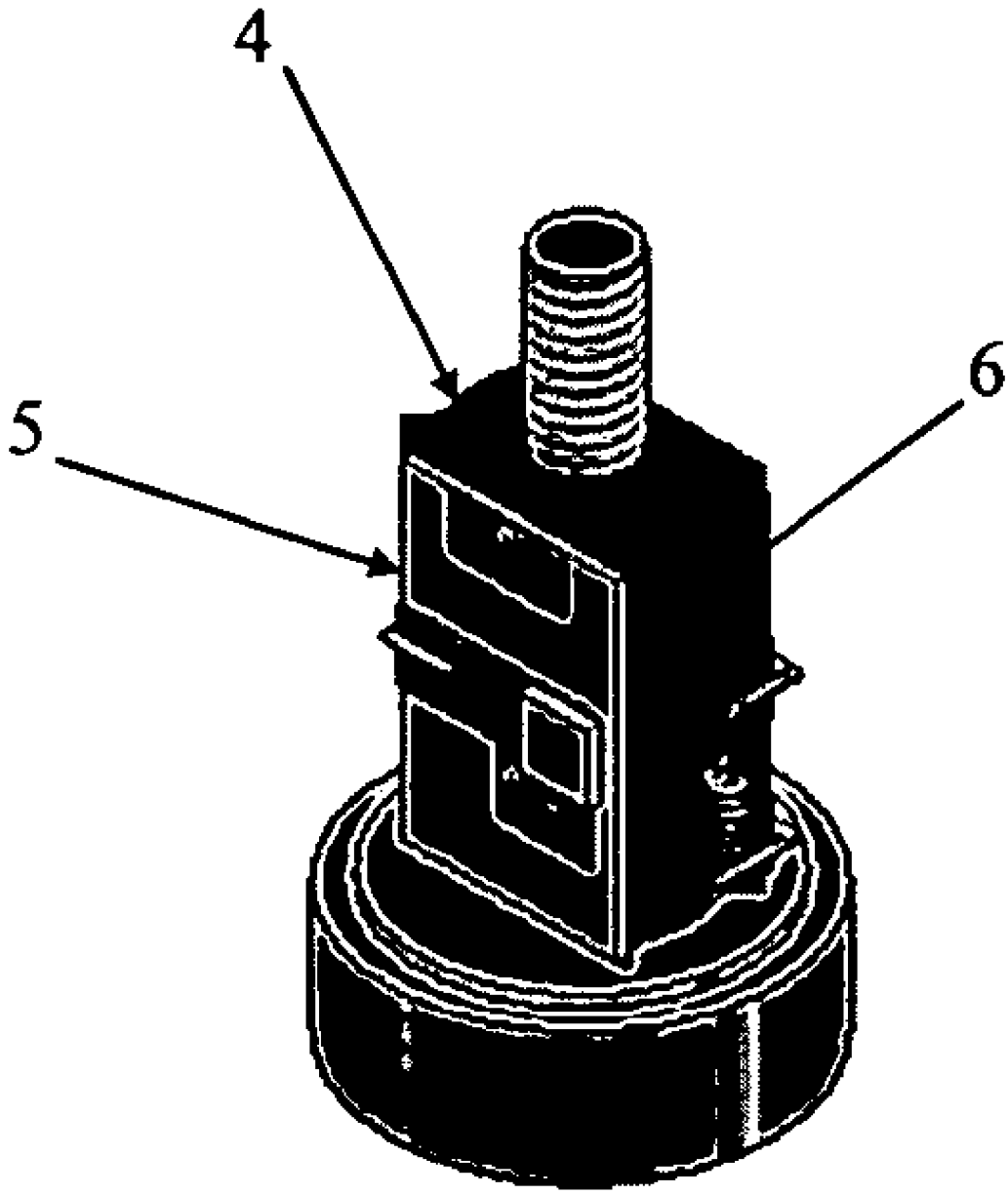
FIG. 4 is a perspective view of the inside structure of a housing of a broadband whip antenna assembly showing the plastic core and two PCBs mounted on the core, according to a preferred embodiment of the present invention.

Referring to FIG. 4, there is shown how to mount the two PCBs 5, 6. As shown, surface mountable capacitors are preferably directly soldered on the boards, while the coils, especially big coils are positioned in the space between two PCBs 5, 6. The circuit and PCB layout are designed in a way that the two PCBs 5, 6 can be jointed by a coil.

The utilization of PCBs makes it possible to apply a variety of circuit topologies for different whips. It is recognized that the present invention can be applied to different frequency bands by adjusting the whip length, circuit element values and maybe circuit topologies. Two different types of matching circuits are given in the next section for different type of whips in different lengths, i.e., quarter wavelength whip, half wavelength whip, etc.

As the whip lengths change, the values of the inductors and capacitors need to be adjusted. And different topologies might be applied. The descriptions given here are for frequency coverage from 138 MHz to 174 MHz. The whip types including quarter wavelength and half wavelength, will be demonstrated separately.

Figure 5:
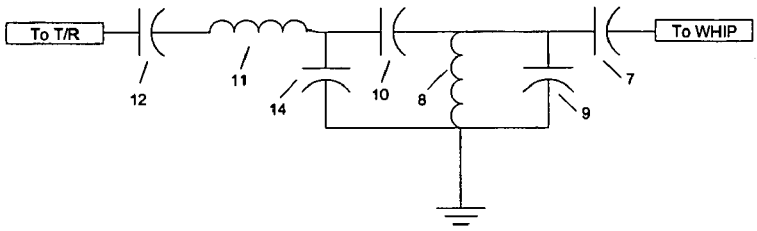
FIG. 5 is a circuit topology for a quarter wavelength broadband whip antenna assembly, according to a preferred embodiment of the present invention.
Figures 6A, 6B, 6C, 6D:
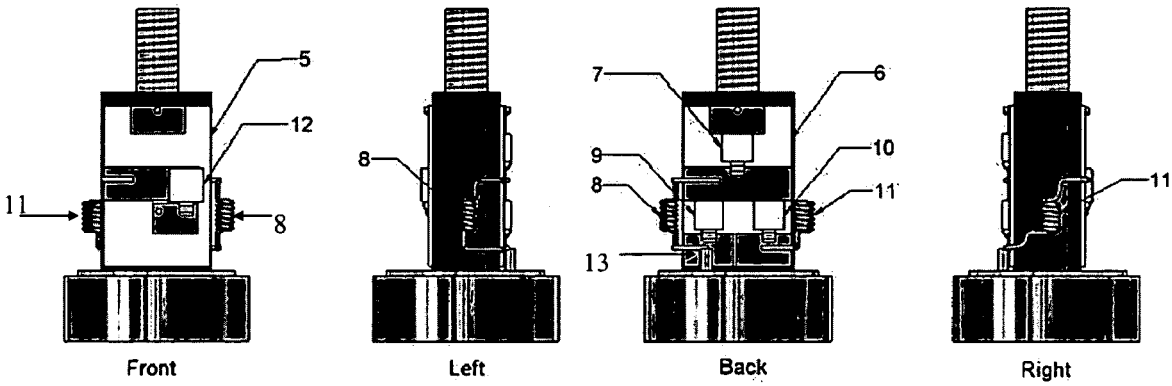
FIGS. 6A, 6B, 6C and 6D are respectively front, left, back and right views of the inside structure of a housing of a quarter wavelength broadband whip antenna assembly, according to a preferred embodiment of the present invention.

Referring to FIG. 5, there is shown a topology of a matching circuit for quarter wavelength whip antenna assembly, according a preferred embodiment of the present invention. FIGS. 6A, 6B, 6C and 6D show the PCBs 5 and 6 with soldered circuit elements. The capacitor 7 is used to reduce the inductivity of the whip 1. The parallel resonant network composed of air coil 8 and capacitor 9 is then used to extend the bandwidth. The series capacitor 10 and shunt capacitor 14 are used to improve the impedance matching. Another resonant network composed of an air coil 11 and capacitor 12 are used to further extend the bandwidth and improve the impedance matching.

Figure 7:
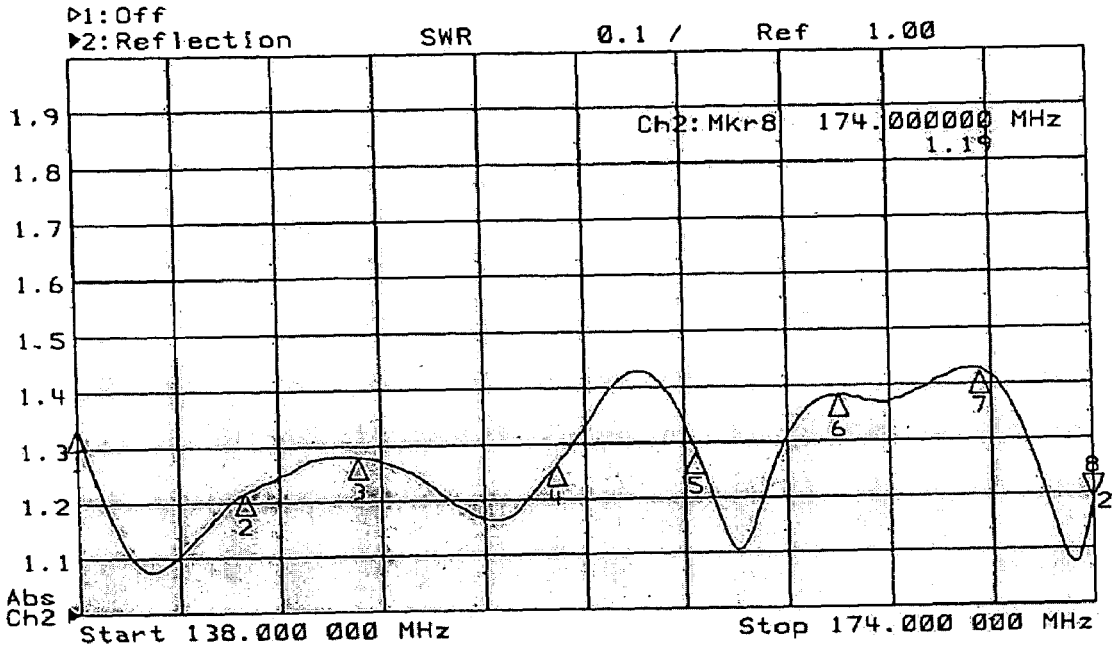
FIG. 7 is a computer generated graph of a measured typical VSWR for a quarter wavelength broadband whip antenna assembly, according to a preferred embodiment of the present invention.

The grounding pin 13 is used to connect the circuit ground to the antenna ground, i.e., vehicle body, via the base. The air coil 11 works not only as part of the matching circuit, but also connection between the two different boards 5 and 6. Comparing FIG. 5 with FIGS. 6A to 6D, it can be noticed that capacitor 14 in the topology disappeared in the final structure. This is because the value of capacitor 14 is very small and can be replaced by parasitic capacitance. The values of the coils and capacitors are optimized to obtain good VSWR. The different whip lengths may result in different values. And the combination of coil and capacitor values to obtain good VSWR is not unique. Table. 1 gives a set of these values. FIG. 7 presents the measured VSWR.

TABLE 2

| The circuit element values for quarter wavelength whip antenna | |
|---|---|
| Capacitor 7 | 9.1 pF |
| Air coil 8 | 6 Turns, 0.105" Diameter |
| Capacitor 9 | 5.6 pF |
| Capacitor 10 | 36 pF |
| Air coil 11 | 6½ Turns, 0.139" Diameter |
| Capacitor 12 | 8.2 pF |
| Capacitor 14 | NULL |

Figure 8:
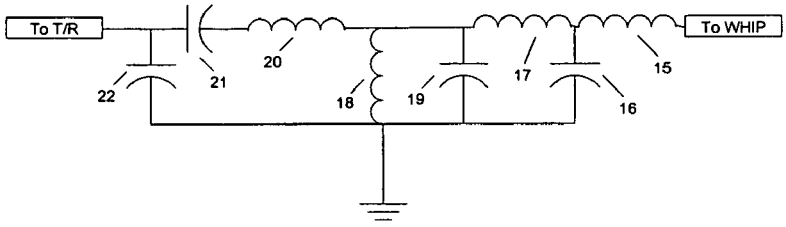
FIG. 8 is a circuit topology for a half wavelength broadband whip antenna assembly, according to a preferred embodiment of the present invention.
Figure 9A:
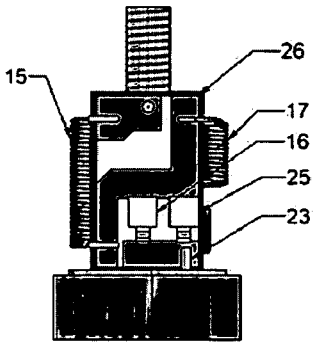
FIGS. 9A, 9B, 9C and 9D are respectively front, left, back and right views of the inside structure of a housing of a half wavelength broadband whip antenna assembly, according to a preferred embodiment of the present invention.
Figure 9B:
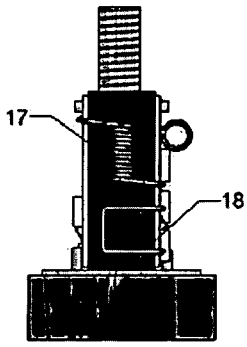
Figure 9C:
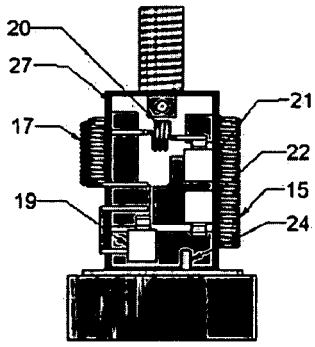
Figure 9D:
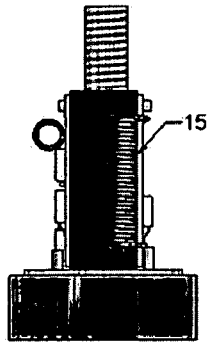
Figure 10:
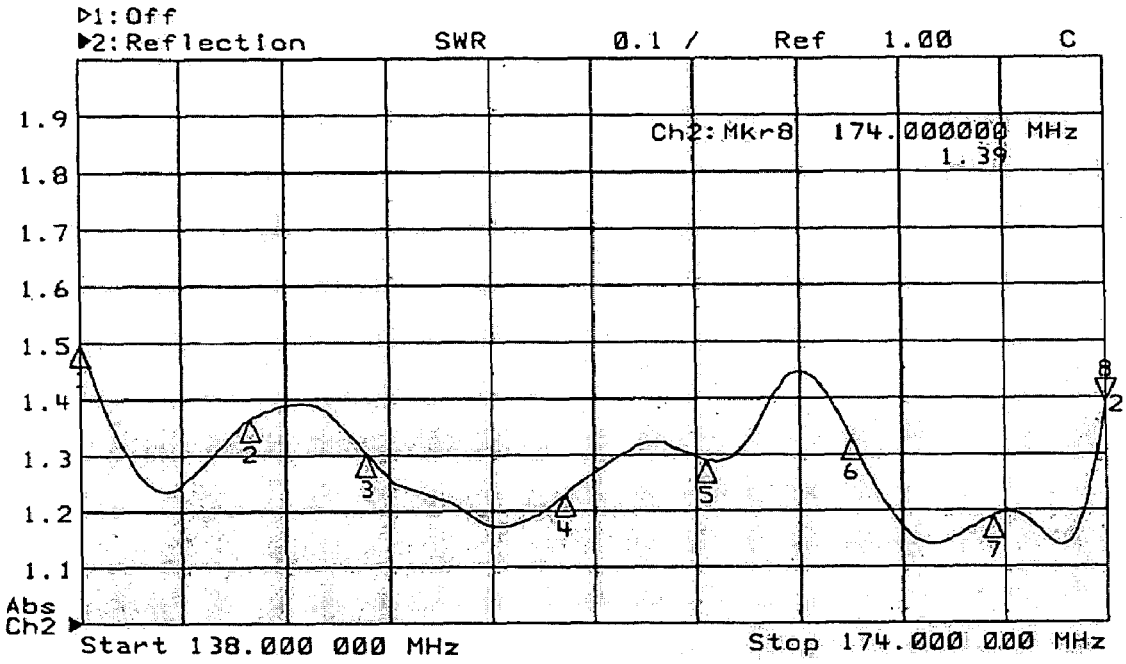
FIG. 10 is a computer generated graph of a measured typical VSWR for a half wavelength broadband whip antenna assembly, according to a preferred embodiment of the present invention.

Referring to FIG. 8, there is shown a circuit topology for half wavelength whip antennas, according to a preferred embodiment of the present invention. A "T" network composed of two air coils 15 and 17 and a shunt capacitor 16 is used to make the whip matched around the center frequency. Then two different resonant networks are used to extend the bandwidth. One of them is in shunt, and composed of the air coil 18 and capacitor 19 in parallel. Another one is composed of air coil 20 and capacitor 21 in series. The shunt capacitor 22 is used to improve the impedance matching.

Referring to FIGS. 9A to 9D, there is shown a layout of the PCBs 26 and 27, and the placement of the coils, according to a preferred embodiment of the present invention. The grounding pins 23 and 24 are used to connect the circuit ground with the base, and consequently, the vehicle body. In FIGS. 9A to 9D, the capacitor 25 is added in parallel to capacitor 16 to obtain desired capacitance. If this value is commercially available, capacitor 25 can be removed. The coils and capacitors have been optimized to obtain good VSWR. The combination of their values is not unique. The change of whip length results in different values too. Table. 2 gives a set of these values.

TABLE 2

| The circuit element values for half wavelength whip antenna | |
|---|---|
| Air coil 15 | 27 Turn, 0.139" Diameter |
| Capacitor 16 | 5.6 pF |
| Air coil 17 | 12½ Turns, 0.105" Diameter |
| Air coil 18 | 0.3" × 0.4" rectangular loop |
| Capacitor 19 | 30 pF |
| Air coil 20 | 3 Turns, 0.1285" Diameter |
| Capacitor 21 | 30 pF |
| Capacitor 22 | 20 pF |
| Capacitor 25 | 2.2 pF |

In the present invention, a highly integrated circuit is used to extend the bandwidth without modifying the whips, without cable sections, and without additional tuning box. The circuit is designed so that it can be integrated into two PCBs. The PCBs are small enough so that they can be assembled into a housing as small as the traditional mobile antenna base. The obtained benefits include:

Good impedance matching

Cost of the materials saved

Time for assembly saved

Consistent antenna performance for mass fabrication

The present invention allows the making of VHF antennas with bandwidth as wide as 138 MHz to 174 MHz, while all circuit elements are contained within such a small antenna base.

In the present invention, all the capacitors and inductors are soldered on two PCBs. No shield is used. So it is easier for assembly and the performance is more consistent. A plastic core inside the housing is used to support the whip, and the two PCBs are mounted on the two sides of the plastic support core. The circuit and the PCB layout are designed in a way that the inductors can be placed on another two sides of the core. And of course, the inductors are small enough so that they can be contained inside the housing. Most important of all, the present invention provides a much more wider bandwidth and better impedance as shown in Table. 3.

TABLE 1

Comparison of the electric performance between the present invention and U.S. Pat. No. 5,604,507

| Antenna Type | ¼ Wavelength | |
|---|---|---|
| | U.S. Pat. No. 5,604,507 | present invention |
| Frequency (MHz) | 144–162 | 138–174 |
| Bandwidth (MHz) | 18 | 36 |
| VSWR | 1.8:1 | 1.5:1 |

The invention provides a way to make cost-effective extremely wide band mobile antennas. The invention uses standard whips without any modification. Coaxial cables are not used for impedance transforming. The matching circuits are integrated on PCBs which are assembled inside the housing.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A broadband mobile antenna assembly comprising:

a whip;

a base defining a housing;

an adaptor extending on top of the base above the housing, for receiving a lower end of the whip;

a mounting element extending in the housing, the mounting element having two opposite PCB mounting side surfaces and two opposite coil mounting surfaces;

two PCBs, each PCB being mountable on the corresponding PCB mounting side surface and fitting in the housing; and matching circuitry integrated on the two PCBs, the matching circuitry having a conductor for connection to the whip when the whip is inserted in the adaptor, and a conductor for external cable connection, the matching circuitry having a series resonant network operatively connected to a parallel resonant network for increasing a bandwidth of the antenna assembly, the series and parallel resonant networks each having a coil mountable to the corresponding coil mounting surface.

2. The broadband mobile antenna assembly according to claim 1, wherein the series resonant network includes a capacitor connected in series to the corresponding coil and the parallel resonant network includes another capacitor connected in parallel to the corresponding coil.

3. The broadband mobile antenna assembly according to claim 2, wherein the whip is connected to the parallel resonant network via a inductivity reducing capacitor.

4. The broadband mobile antenna assembly according to claim 3, wherein the series resonant network is connected to the parallel resonant network via a capacitor in series and a capacitor in shunt.

5. The broadband mobile antenna assembly according to claim 2, wherein the whip is connected to the parallel resonant network via a T matching network having two coils in series and a shunt capacitor.

6. The broadband mobile antenna assembly according to claim 5, wherein the conductor for external cable connection is connected to the series resonant network via an impedance matching capacitor in shunt.

7. The broadband mobile antenna assembly according to claim 1, wherein the antenna assembly operates between frequencies of 138 MHz to 174 MHz, with a VSWR of less or equal than 1.5:1.

* * * * *